US006213469B1

(12) United States Patent
Lucio et al.

(10) Patent No.: US 6,213,469 B1
(45) Date of Patent: Apr. 10, 2001

(54) BALL RETURN SYSTEM

(75) Inventors: Maurício V Lucio; Kimberly J Lucio, both of Fairfield, CT (US)

(73) Assignee: Mauricio V. Lucio, Fairfield, CT (US)

( * ) Notice: Subject to any disclaimer, the term of this patent is extended or adjusted under 35 U.S.C. 154(b) by 0 days.

(21) Appl. No.: 09/027,789

(22) Filed: Feb. 23, 1998

(51) Int. Cl.[7] ..... A63B 63/00
(52) U.S. Cl. ..... 273/395; 273/396; 473/476
(58) Field of Search ..... 273/395, 396, 273/394; 473/494, 490, 492, 495, 476, 478

(56) References Cited

U.S. PATENT DOCUMENTS 795,317 * 7/1905 Tanty ..... 473/494
5,549,304 * 8/1996 Davis ..... 273/396
5,842,940 * 12/1998 Macaluso ..... 473/478

FOREIGN PATENT DOCUMENTS

2172509 * 9/1986 (GB) ..... 273/400

* cited by examiner

*Primary Examiner*—Sam Rimell
(74) *Attorney, Agent, or Firm*—St. Onge Steward Johnston & Reens LLC

(57) ABSTRACT

The ball return system has two horizontal poles, top and bottom, thus stretching the material vertically. The ball return system has two vertical poles, right and left, thus stretching the material horizontally forming the face of the frame. Attached to the horizontal and vertical poles are four angled poles looped through the material, two on left side and two on right side—the top angled poles on either side extend to the ground thus supporting the system—thus attached to a horizontal pole in the mid-section, in front of material of the front frame, causing an infinite amount of different directional returns. The attached weights to the mid-section horizontal pole secure the system.

4 Claims, 1 Drawing Sheet

BALL RETURN SYSTEM

BACKGROUND OF THE INVENTION

This invention relates to a goal, where a ball is launched, rebounded and returned.

This ball return system enables an individual to play with all types of balls, without a companion.

Prior return ball systems have had many disadvantages. One major difficulty is the stability of other systems upon the impact of the ball. Another common difficulty is the material used to rebound the impact of the ball, to its fullest capacity. Therefore, these other systems do not promote accuracy or consistent play.

BRIEF SUMMARY OF THE INVENTION

This invention is directed to enhance consistent and accurate uninterrupted action. The purpose of this invention is to provide an uninterrupted and successful practice session without the need for a partner. The ball return system is both foldable and portable.

The ball return system is comprised of material attached to a frame, that stretches and causes the return of a ball with enough force to repeat play.

DETAILED DESCRIPTION OF THE INVENTION

Figure 1:
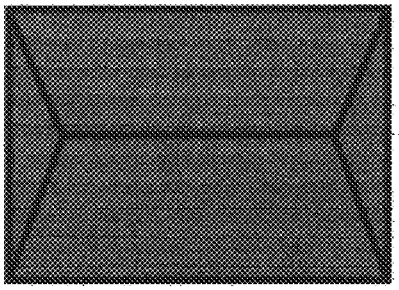
FIG. 1 is an exploded front view of the ball return system of the invention used for the practice and play with any ball.
Figure 2:
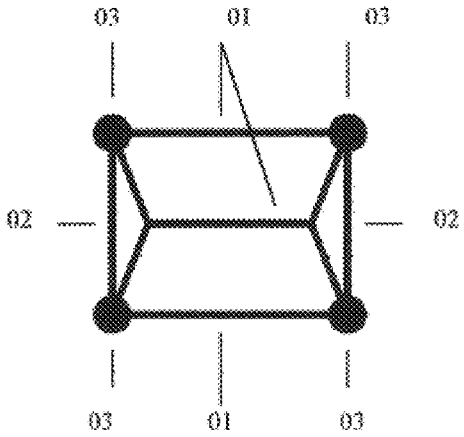
FIG. 2 is a front view of the ball return system frame of FIG. 1.

Referring to FIG. 1 is the front of the ball return system showing the face of the frame 1 and material 16 where ball is projected into. Referring to FIG. 2, the horizontal upper pole 01 and lower pole 01 are connected to 90 degree elbow 03, that are connected to vertical Right and left poles 02, the horizontal center pole is connected to Back pole 04 of FIG. 3.

Figure 3:
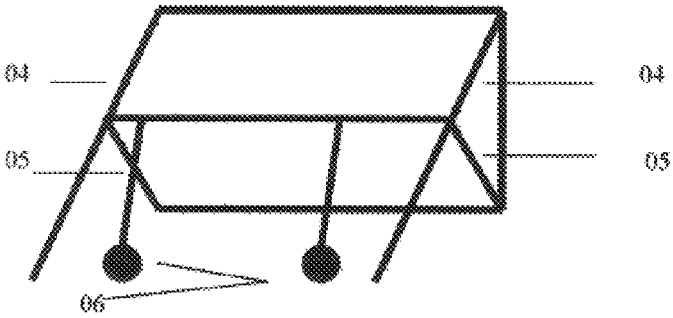
FIG. 3 is a back view of the ball return system of FIG. 1.
Figure 4:
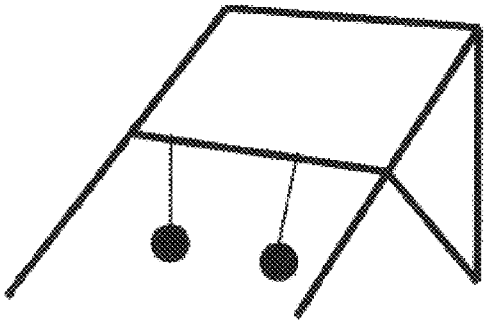
FIG. 4 is a side view of the ball return system of FIG. 1.

Referring to FIG. 3 is the back of the ball return system Showing the back support poles 04 and lower support poles 05, and Weight control 06 attached to horizontal center pole 01 of FIG. 2, ALL PIECES ARE CONNECTED BY PLATES AND SCREWS.

While there has been shown and described a preferred embodiment Of the system of this invention. It is understood that changes in structure, sizes and shapes can be made by those skilled in the art Without departing from the invention. The invention is defined in the Following claims.

We claim:

1. A ball return system used to rebound a ball, the system comprising: a frame which can be adjusted to different configurations, the frame comprising an upper horizontal pole, a lower horizontal pole and a mid-level horizontal pole, the mid-level horizontal pole located along an axis having a plane located between the plane of the axis of the upper horizontal pole and the plane of the axis of the lower horizontal pole; material attached to the frame such that, when a ball is propelled at the material, the material stretches and causes the ball to rebound; and at least one weight disposed on the mid-level horizontal pole to stabilize the frame.

2. The ball return system of claim 1 wherein: the resistance and stretch of the material is sufficient such that, when a ball is projected into the system, it is caused to return with enough force to repeat play.

3. The ball return system of claim 1 wherein: the frame restricts and contracts upon propulsion.

4. The ball return system of claim 1 wherein: the weights secure, stabilize and immobilize.

* * * * *